US008331812B2

(12) United States Patent
Yasutomi

(10) Patent No.: US 8,331,812 B2
(45) Date of Patent: Dec. 11, 2012

(54) IMAGE FORMING APPARATUS

(75) Inventor: Kei Yasutomi, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 365 days.

(21) Appl. No.: 12/707,288

(22) Filed: Feb. 17, 2010

(65) Prior Publication Data

US 2010/0215384 A1 Aug. 26, 2010

(30) Foreign Application Priority Data

Feb. 20, 2009 (JP) ..... 2009-038217

(51) Int. Cl.
*G03G 15/00* (2006.01)

(52) U.S. Cl. ..... 399/45

(58) Field of Classification Search ..... 399/15, 399/45, 46, 49, 389
See application file for complete search history.

(56) References Cited

U.S. PATENT DOCUMENTS

| | | | | |
|---|---|---|---|---|
| 6,215,552 | B1 * | 4/2001 | Acquaviva et al. | 356/601 |
| 7,315,379 | B2 * | 1/2008 | Jinno | 356/445 |
| 7,551,868 | B2 | 6/2009 | Yasutomi et al. | |
| 7,620,336 | B2 | 11/2009 | Yura et al. | |
| 7,657,218 | B2 | 2/2010 | Maruyama et al. | |
| 7,679,747 | B2 * | 3/2010 | Kuwada | 356/445 |
| 2006/0115306 | A1 * | 6/2006 | Lofthus et al. | 399/341 |
| 2008/0056784 | A1 | 3/2008 | Nakamura et al. | |
| 2008/0261768 | A1 | 10/2008 | Miyawaki et al. | |
| 2009/0003904 | A1 | 1/2009 | Yasutomi et al. | |
| 2010/0002265 | A1 | 1/2010 | Yasutomi | |

FOREIGN PATENT DOCUMENTS

| | | |
|---|---|---|
| JP | 2005-352401 | 12/2005 |
| JP | 2006-30978 | 2/2006 |
| JP | 2006-261820 | 9/2006 |
| JP | 4096163 | 3/2008 |

* cited by examiner

*Primary Examiner* — David Gray
*Assistant Examiner* — Gregory H Curran
(74) *Attorney, Agent, or Firm* — Oblon, Spivak, McClelland, Maier & Neustadt, L.L.P.

(57) ABSTRACT

An image forming apparatus includes an image forming unit and a surface reflection detector. The image forming unit includes an image forming station to form a detection sample image and a toner image on a recording medium, a controller to set a detection sample image output mode to output the detection sample image, and a fixing device to fix the detection sample image and the toner image on the recording medium. The surface reflection detector is connected to the controller to detect reflection characteristics of a surface of the recording medium and includes a projector to project parallel light against a target and an angular distribution detector to detect an angular distribution of light reflected from the recording medium and the detection sample image. Based on the detection result, imaging conditions are adjusted and an output image is formed.

15 Claims, 7 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2009-038217, filed on Feb. 20, 2009 in the Japan Patent Office, which is hereby incorporated herein by reference in its entirety.

BACKGROUND OF THE INVENTION

1. Field of the Invention

Exemplary aspects of the present invention generally relate to an image forming apparatus, and more particularly to control of glossiness of an image produced by the image forming apparatus.

2. Description of the Background Art

As is well known, an image forming apparatus using electrophotography forms an electrostatic latent image on a photoreceptor serving as a latent image bearing member and develops the latent image with toner into a visible image, also known as a toner image. The toner image is then transferred onto a recording medium such as a sheet of paper and fixed thereon.

Such an output image includes not only a monochrome image, but also a color image consisting of multiple colors. The appearance of the image and reproducibility of the colors depend significantly on glossiness of the image as well as glossiness of the recording medium. It is known that when glossiness of the image corresponds to glossiness of the recording medium, the output image appears to be natural. That is, one may feel that the image has a sense of uniformity. Thus, it is necessary to match the glossiness of the recording medium and the image.

Attributes that determine glossiness include factors such as fusing ability and permeability of the toner relative to the recording medium. In order to fuse the toner to the recording medium, a fixing device is used.

Generally, there are two fixation methods employed by the fixing device for fixing the toner image: a fixing method using a heating roller and a fixing method using a belt. The fixing method using the heating roller uses a fixing roller, equipped with a heat source such as a halogen lamp or the like inside the fixing roller, and a pressure roller that contacts the fixing roller. The fixing method using the belt uses a fixing belt having a relatively small heat capacity.

In the fixing method using the belt, the fixing belt includes an elastic layer formed of silicone rubber or the like on which a separation layer of fluorocarbon polymer is formed. The fixing belt is wound around a plurality of rollers and stretched therebetween. A pair of rollers consisting of a stretch roller and a pressure roller is disposed such that the stretch roller faces the pressure roller through the fixing belt, thereby defining a fixing nip. The heat source such as a halogen lamp is provided inside the stretch roller.

In such a fixing device, the recording medium bearing the toner image thereon is transported between the fixing belt and the pressure roller. As the recording medium passes therebetween, the toner in different colors is heated and fused, thereby fixing the color toner image on the recording medium.

The fixing method using the belt is advantageous in that the belt member provides greater flexibility in forming the fixing nip, enabling fixation of the toner image at low temperature (thus saving energy) and enhancing separability of the recording medium from the fixing belt.

Additionally, there are various types of recording media sheets on which such a toner image is fixed. For example, the recording media include, but are not limited to, ordinary paper, art paper, coated paper, semi-coated paper, and so forth. Ordinary paper or the like has a relatively rough surface. In other words, surface asperity is significant so that glossiness of the ordinary paper is low. However, in recent years, market demand has also grown for an ability to produce high-quality images on art paper, coated paper, and slightly-coated paper, the surfaces of which are relatively smooth, that is, surface asperity is small and glossiness is high. Generally, the surface of art paper and coated paper has a coating layer formed of resin or the like. Therefore, glossiness is high compared with ordinary paper. Also, in recent years, in order to add a quality appearance to a paper document, use of matte-coated paper having glossiness similar to that of ordinary paper is increasing.

Therefore, there is demand for an image forming apparatus that can reliably form a quality image on various types of paper. As noted above, conventionally glossiness is considered to be one of several attributes that determine the quality of the overall appearance and color reproducibility of an image. In order to achieve desirable glossiness, a balance between glossiness of the recording medium on which no image is formed (hereinafter referred to as "non-image area") and the gloss of an image area of the recording medium where the image is formed (hereinafter also referred to as "high density portion" or "toner image portion") needs to be optimized.

Conventionally, glossiness of an image is evaluated or quantified using a 60-degree glossiness scale according to Japanese Industrial Standards (JIS). In this method, glossiness is measured at a 60-degree angle from the horizon. Using this method, when the measured glossiness of the recording medium and the measured glossiness of the image portion correspond to each other, it is believed that an image with a desirable gloss is obtained.

However, the present inventor has noticed that the perceived gloss may not coincide with the measured glossiness using the conventional method, and glossiness of various kinds of sheets of recording media and the image portion of such media cannot be defined by a generally known single indicator/numerical value "glossiness". One reason for such divergence between the perceived gloss and the measured glossiness is that the difference in refractive indices of the recording medium and the toner of the image portion causes a significant difference in the total amount of light reflected from the surface of the recording medium.

Moreover, even if the measured glossiness of the recording medium and the image portion correspond numerically, one may still feel that gloss between the recording medium and the image portion lacks uniformity.

In order to obtain a desirable gloss, in one related-art approach, a toner fixing speed is adjusted to control fusing of the toner image based on the surface roughness of the recording medium. In this approach, the distribution of the light reflected by the recording medium (reflected light distribution curve) is obtained to specify the surface roughness Ra of the recording medium. Accordingly, fixing conditions can be adjusted to fix the toner image onto the recording medium using only an appropriate amount of heat.

Although advantageous, this approach suffers from a drawback. For example, even if the distribution of the light reflected by the recording medium is detected, the distribution of the light reflected by the image portion is not measured. Consequently, it is not possible to set the distribution of the reflected light to a similar if not the same distribution for both the recording medium and the image portion.

In another related-art approach, in order to achieve a desirable gloss of the toner image and the recording medium, an image is formed to satisfy a standardized predetermined distribution of specular reflection light, and the fusing ability of the toner is then adjusted to achieve that standardized predetermined distribution of the specular reflection light.

Although this approach focuses on the distribution of the reflected light (an angle that is the half value of a reflected light peak), the standard of reference is glass plate. In other words, this approach focuses on achieving the high gloss image (texture) of silver halide photographs rather than coated paper. Furthermore, this approach determines mainly whether or not the produced image satisfies standardized predetermined conditions. As such this approach does not propose how to obtain appropriate gloss on different kinds of recording media sheets.

Alternatively, there is another approach in which an image is formed by incorporating information on image glossiness and texture using not only the specular reflection light but also upper diffuse reflection light.

However, this approach relates to a reading device and does not address a problem associated with the use of "glossiness" as a parameter for evaluation of gloss when the reflected light flux differs between different kinds of recording media sheets. Also, this approach does not suggest obtaining the distribution of the light reflected from the non-image area to correspond to the image area (toner image area).

Conventionally, with high-gloss paper, a user may need to try out different kinds of output modes such as a "gloss paper mode", "a thick paper mode", and so forth to make gloss of the non-image portion and the image portion have a sense of uniformity. Yet even despite the effort, a desirable gloss may still not be obtainable.

As described above, it is difficult to determine whether or not the recording medium that the user wishes to use can provide desirable gloss by using the conventional "glossiness" as an indicator.

SUMMARY OF THE INVENTION

In view of the foregoing, in one illustrative embodiment of the present invention, an image forming apparatus includes an image forming unit and a surface reflection detector to detect reflection characteristics of a surface of a recording medium. The image forming unit includes an image forming station, a controller, a fixing device. The image forming station forms a detection sample image and a toner image on the recording medium. The controller sets a detection sample image output mode to output the detection sample image. The fixing device fixes the detection sample image and the toner image on the recording medium. The surface reflection detector is connected to the controller and includes a projector to project parallel light against a target and an angular distribution detector to detect an angular distribution of light reflected by the target. The angular distribution detector detects the angular distribution of reflected light on the recording medium and on the detection sample image formed on the recording medium. The image forming unit forms an output image on the recording medium by adjusting imaging conditions based on the angular distribution of reflected light on the recording medium and the detection sample image detected by the angular distribution detector.

In another illustrative embodiment of the present invention, an image forming apparatus includes an image forming unit, a first surface reflection detector, and a second surface reflection detector. The image forming unit includes an image forming station, a controller, and a fixing device. The image forming station forms a detection sample image and a toner image on a recording medium. The controller sets a detection sample image output mode to output the detection sample image. The fixing device fixes the detection sample image and the toner image on the recording medium. The first surface reflection detector is disposed proximal of the image forming station to detect reflection characteristics of the recording medium and includes a first projector to project parallel light against the recording medium and a first angular distribution detector to detect an angular distribution of light reflected from the recording medium. The second surface reflection detector is disposed distal of the fixing device to detect reflection characteristics of the detection sample image on the recording medium and includes a second projector to project parallel light against the detection sample image and a second angular distribution detector to detect an angular distribution of light reflected from the detection sample image. The image forming unit forms an output image on the recording medium by adjusting imaging conditions based on the angular distribution of reflected light on the recording medium and on the detection sample image detected by the first angular distribution detector and the second angular distribution detector.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
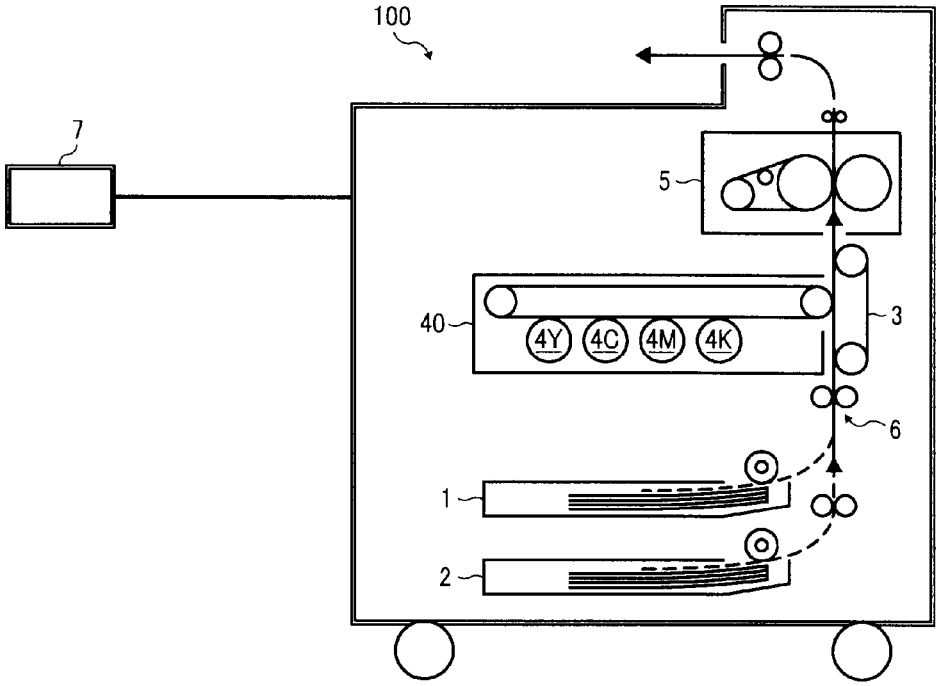
FIG. 1 is a schematic diagram illustrating an image forming apparatus according to a first illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating an image forming apparatus 100 according to a first illustrative embodiment of the present invention. In FIG. 1, the image forming apparatus 100 includes sheet feed cassettes 1 and 2 at the bottom of the image forming apparatus 100, a color image forming station 40, a transport belt 3, a pair of registration rollers 6, a fixing device 5, a surface reflectance detector 7, and so forth. The image forming station 40 and the fixing device 5 serve as an image forming unit.

The sheet feed cassettes 1 and 2 store recording media sheets. The recording media sheets include, but are not limited to, business paper such as ordinary paper commonly used in a copier or a printer; coated paper such as cast coated paper, art paper, and light-weight coat paper; non-coated paper such as wood-free paper (fine paper), ground wood (medium grade) paper, and ground wood (low grade) paper; and an OHP sheet made of plastic such as PET.

According to the first illustrative embodiment, the recording media sheets stored in the sheet feed cassettes 1 and 2 refer to the coated paper.

The recording medium discharged from the sheet feed cassette 1 is transported upward along a sheet transport path of the image forming apparatus 100. The transport belt 3 carries the recording medium on the surface thereof and transports the recording medium upward.

The image forming unit includes the color image forming station 40 (hereinafter simply referred to as the image forming station) and the fixing device 5. In the image forming station 40, writing, development, transfer of an image onto the recording medium, and cleaning a photoreceptor are performed. The image forming station 40 forms toner images of yellow (Y), cyan (C), magenta (M), and black (K). The toner images of each color are superimposed on one another and transferred onto the recording medium on the transfer belt 3. In the image forming station 40, the toner image may be formed with dry toner (powder toner) and fixed onto the recording medium by the fixing device 5.

The pair of the registration rollers 6 sends the recording medium to the color image forming station 40 in appropriate timing such that the recording medium is aligned with the toner image formed in the color image forming station 40. The recording medium on which the toner images are transferred is transported upward by the transport belt 3.

The recording medium bearing the toner image on the surface thereof is transported to the fixing device 5. As the recording medium passes through the fixing device 5, the toner image is heated and pressed against the recording medium so that the toner image is fixed on the recording medium.

As will be later described, the fixing device 5 can change the transport speed of the recording medium at fixation. The transport direction of the recording medium on which the toner image is fixed by the fixing device 5 is switched to the left in FIG. 1 substantially at the upper portion of the image forming apparatus 100. The recording medium is discharged outside the image forming apparatus 100.

As will be later described in detail, the surface reflection detector 7 detects an angular distribution of reflected light as a surface reflection characteristic.

According to the first illustrative embodiment, the surface reflection detector 7 projects a parallel light to the recording medium and an image portion of a detection sample image formed on the recording medium. The angular distribution or expansion of reflected light reflected from the surface is detected.

In the image forming apparatus 100, the detection sample image designated for reading the angular distribution of the reflected light by the surface reflection detector 7 is output at a detection sample image output mode. According to the present embodiment, the surface reflection detector 7 reads the angular distribution of the reflected light on the non-image portion (sheet portion) and the image portion of the detection sample image that is output in the detection image output mode.

Based on the result of detection, fixing conditions are adjusted, and an output image (not the detection sample image) is output.

Figure 2:
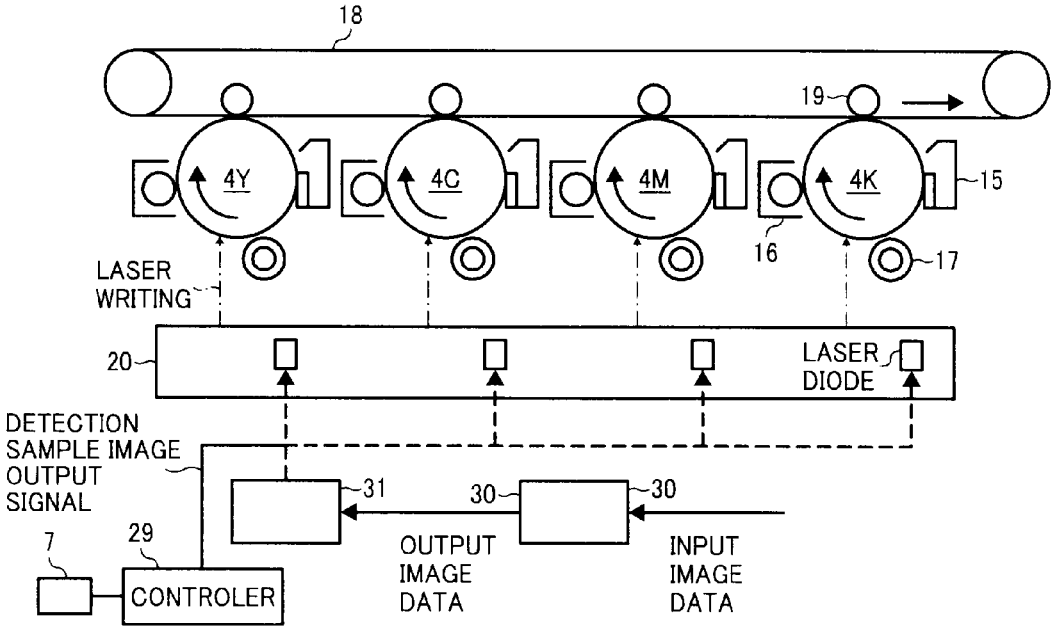
FIG. 2 is a schematic diagram illustrating an image forming station employed in the image forming apparatus of FIG. 1.

Referring now to FIG. 2, there is provided a schematic diagram illustrating the color image forming station 40 of the image forming apparatus 100 according to the first illustrative embodiment.

In FIG. 2, the image forming station 40 includes four image forming devices for forming toner images of yellow, cyan, magenta, and black. Four image forming devices all have the same configuration, differing only in the color of toner employed. Therefore, a description is provided of the image forming unit for yellow as a representative example.

The image forming station 40 includes a photoreceptor drum 4Y, a charging device 17, a laser optical unit 20, a developing device 16, a primary transfer device 19, and a cleaning device 15. An electrostatic latent image is formed on the photoreceptor drum 4Y by the laser optical unit 20. Then, the developing device 16 develops the electrostatic latent image with the respective color of toner, thereby forming a visible image, the toner image. The primary transfer device 19 transfers the toner image from the photoreceptor drum 4Y to the intermediate transfer device 18. The cleaning device 15 cleans residual toner that is not transferred to the intermediate belt transfer device 18, thus remaining on the photoreceptor 4Y.

The toner images of yellow, cyan, magenta, and black are sequentially and overlappingly transferred onto the belt-type intermediate transfer device 18 (intermediate transfer belt) that contacts the photoreceptor drums 4Y, 4C, 4M, and 4K, thereby forming a composite toner image.

The intermediate transfer device 18 is rotated at predetermined timing by a driving device, not illustrated, so as to superimpose the four toner images at a certain position on the intermediate transfer device 18. The composite toner image is transferred onto the recording medium.

Next, a description is provided of operation of an image processor 30 from input of the image data to obtaining an output image. Input data from a scanner when using a copier or from a personal computer when using a printer includes an RGB multilevel image of 8 bit in most cases. Enhancement processing is performed on the input data in an MTF filter part in the image processor 30. Subsequently, the input data is decomposed from the RGB color space into CMYK color space. Then, a gradation correction part (γ conversion part) controls concentration to realize a predetermined gradation.

Subsequently, in a pseudo-halftone processing part, pseudo-halftone processing is performed so as to accommodate characteristics of the printer. The data is sent as output image data (600 dpi, 4 bit data) to a video signal processor 31 at the image output side.

Next, a description is provided of the video signal processor 31. Here, a flow of data of a single color, for example, yellow, is explained. The video signal processor 31 is provided to each of the colors, yellow, cyan, magenta, and black, and the same processing is performed for each color. Thus, a description is provided of the flow of data of the color yellow.

The video signal processor receives the output image data which is the resulting product of the image processing, stores the data for a number of light-emitting points on a line memory. The data on the line memory corresponding to each pixel is sent to a PWM controller at a predetermined timing (pixel clock) in accordance with a signal synchronous with rotation of a polygon mirror. It is to be noted that the number of light-emitting point is one for each color.

In the PWM controller, the data is converted to a pulse width modulation signal (hereinafter referred to as PWM signal) and sent to an LD driver. In the LD driver, an LD element (LD array) is optically modulated and driven at a predetermined amount of light to respond to the PWM signal. According to the present embodiment, the PWM control is performed corresponding to the output image data of each color component, and a laser beam is optically modulated.

The light emitted from the LD element is formed into a parallel light by a collimating lens. An aperture shapes the parallel light passing through the collimating lens into a light flux corresponding to a desirable beam diameter. After passing through the aperture, the light flux passes through a cylindrical lens and enters the polygon mirror. The light flux is reflected by the polygon mirror and focused by a scan lens (f-θ lens). Then, the light flux is reflected by a reflection mirror and imaged on the photoreceptor, thereby forming an electrostatic latent image.

After the electrostatic latent image is formed on the photoreceptor drum, the electrostatic latent image is developed with toner as the toner image and transferred onto a recording medium.

During the detection sample image output mode for outputting the detection sample image, an output signal of the detection sample image is sent from a controller 29, instead of sending the signal of the output image data. During this mode, the detection sample image is formed on the recording medium.

Now, a description is provided of one example of toner used in the first illustrative embodiment. The toner used herein is made using a polymerization method. In order to realize oil-less fixation in the fixing device 5, the toner includes wax serving as a release agent inside thereof.

A volume average particle diameter of the toner is approximately 5.5 μm. The particle diameter of the toner is measured by the Coulter counter TA-2 manufactured by Coulter Co. with an aperture diameter of 100 μm. Four toners of different colors, yellow, cyan, magenta, and black are manufactured by the similar, if not the same way as one another. Alternatively, the manufacturing method is not limited to the above described method. The toner can be manufactured by a dispersion polymerization method, a pulverization method, and so forth.

Figure 3:
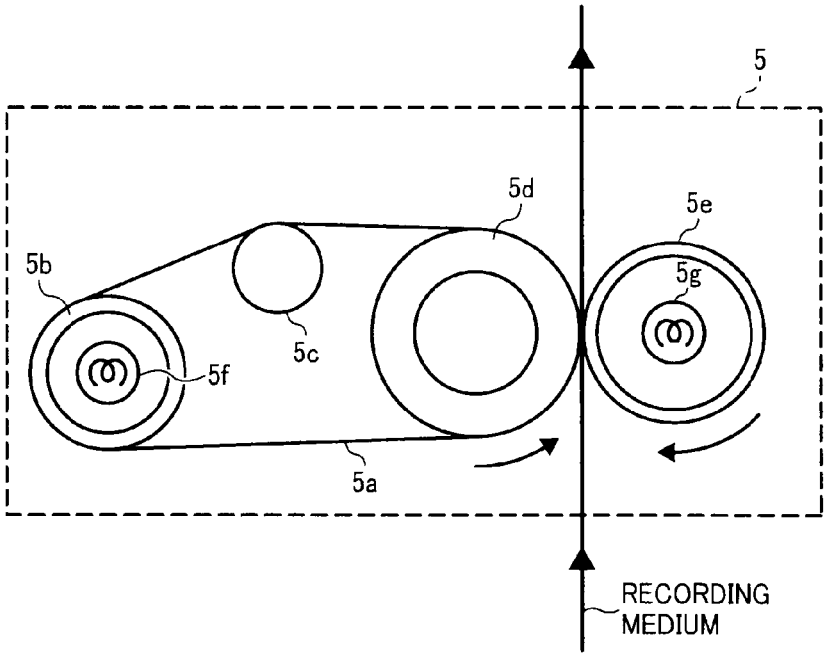
FIG. 3 is an explanatory schematic diagram illustrating a fixing device employed in the image forming apparatus of FIG. 1.

A description is now provided of the fixing device 5 according to the first illustrative embodiment. FIG. 3 is an explanatory schematic diagram of the fixing device 5. In FIG. 3, the fixing device 5 includes a fixing belt 5*a*, a heating roller 5*b*, a tension roller 5*c*, a sponge roller 5*d*, a pressure roller 5*e*, and halogen heaters 5*f* and 5*g*. The sponge roller 5*d* presses the fixing belt 5*a* from the inner loop of the fixing belt 5*a*. The pressure roller 5*e* presses the fixing belt 5*a* from the front surface thereof. The fixing belt 5*a* is wound around the sponge roller 5*d*, the heating roller 5*b*, and the tension roller 5*c*, and rotates. The halogen heater 5*f* serving as a heat source is disposed inside the pressure roller 5*b*. Similarly, the halogen heater 5*g* is disposed inside the pressure roller 5*e*.

The fixing belt 5*a* is formed of a polyimide film base of approximately 90 μm thickness having a conductive carbon dispersed therein. An elastic layer formed of silicone rubber of 200 μm thickness is disposed on the polyimide film base. As a layer that contacts the toner image, a PFA layer of 50 μm is formed on the elastic layer. When the surface property of the fixing belt 5*a* is measured, the average surface roughness is approximately 0.03 μm.

The sponge roller 5*d* is formed of a foam silicone roller of approximately 10 mm thickness. The pressure roller 5*c* includes an aluminum roller on which a silicone rubber layer of 1.5 mm thickness is provided. The plate thickness of the aluminum roller is approximately 1.5 mm.

The recording medium on which the toner image is formed by the image forming station 40 is transported substantially from the bottom of the image forming apparatus 100 to the fixing device 5. When the recording medium contacts the fixing belt 5*a*, the toner image on the recording medium is fused and pressed against the recording medium. Accordingly, the toner image is fixed onto the recording medium. Subsequently, the recording medium discharged from the fixing device 5 is discharged as an output image outside the image forming apparatus 100 as described above.

The foregoing description pertains to one example of the fixing device. The configuration thereof is not limited to the configuration described above.

Figure 4:
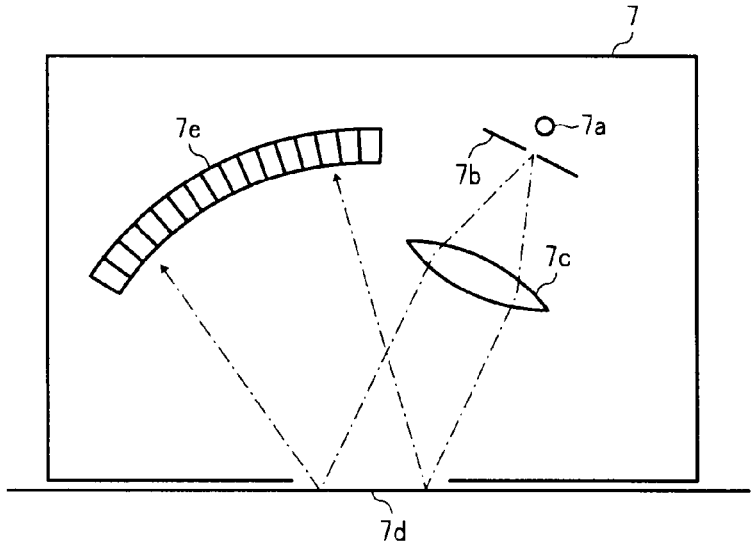
FIG. 4 is an explanatory schematic diagram illustrating a surface reflection detector according to the first illustrative embodiment.

Next, a description is provided of the surface reflection detector 7 according to the first illustrative embodiment. FIG. 4 is an explanatory schematic diagram illustrating the surface reflection detector 7. In FIG. 4, the surface reflection detector 7 includes a light projecting device 7*a* including an LED light source, an aperture 7*b*, and a collimating lens 7*c*. The aperture 7*b* shapes a light flux into a desirable light flux. The light flux passed through the aperture 7*b* is formed into parallel light which illuminates a detection target, that is, a recording medium 7*d* or an image on the recording medium 7*d*.

A light receiving device 7*e* serving as an angular distribution detector detects the intensity of light reflected from the recording sheet 7*d* or an image portion on the recording sheet 7*d* as an angular distribution of the reflected light. According to the first illustrative embodiment, the light receiving device 7*e* serves as a detector for the angular distribution of the reflected light.

The light receiving device 7*e* includes a CCD array disposed in an arc shape. The intensity of light is converted to electric signals by each CCD element so that the angular distribution of the light intensity is output as a signal.

According to the first illustrative embodiment, in the surface reflection detector 7, parallelism of the parallel light that is projected onto the detection target, that is, the recording medium 7*d*, is equal to or less than 1.0 degree. The diameter of the light projected to the recording medium 7*d* is approximately 3 mm. The space between each of the CCDs of the CCD array disposed in the arc shape is approximately 1.0 degree.

With this configuration, the angular distribution of the reflected light is detected at an angular resolution of 1.0 degree. The parallel light is projected to the detection target at a 20-degree position when the vertical direction of the detection target is 0 degree.

Figure 5:
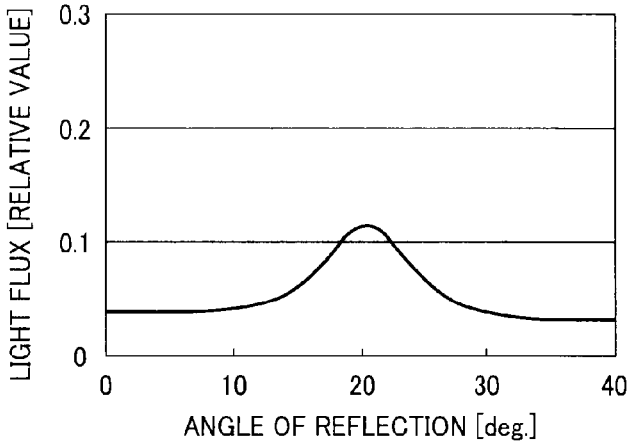
FIG. 5 is a graph showing an example of an angular distribution of reflection on a non-image portion (a portion of a recording medium on which no image is formed)

FIG. 5 is a graph showing an example of a detection result output from the surface reflection detector 7. In FIG. 5, the horizontal axis represents an angle of reflection, and the light receiving position is expressed in angle when the vertical direction of the detection target (recording medium 7*d*) is set to 0 (zero) degree. FIG. 5 shows the angular distribution of the reflected light when the measurement is made using a POD gloss coated sheet manufactured by Oji Paper Corporation, having a sheet weight of 128 g as a detection target.

In the first illustrative embodiment, a standard deviation is obtained by approximating the detection result, that is, the angular distribution of the reflected light with the Gaussian distribution (normal distribution). Here, the standard deviation is obtained assuming that the angular distribution of the reflected light on the recording medium corresponds to the Gaussian distribution (normal distribution).

Now, the description is provided of one example of a fitting method in which the angular distribution of the reflected light is fitted with the normal distribution. There are various ways of fitting the angular distribution of the reflected light with the normal distribution. Thus, the fitting method is not limited to the following method. The standard deviation of the angular distribution of the reflected light can be obtained using other methods.

In the present embodiment, a standard deviation σ is obtained from the angular distribution of the reflected light by the following equation:

$$\rho(\theta)=A*\exp(-(\theta-\theta 0)^2/(2\sigma^2))+B$$

The standard deviation σ of the normal distribution is derived such that each parameter (A, θ0, σ, and B) is changed to derive a combination of parameters by which a minimum residual sum of squares with the measured data described above is obtained. For information, the standard deviation σ is 3.7 degrees for the angular distribution of the reflected light shown as an example in FIG. 5.

The description is now provided of adjustment of imaging conditions. Based on the standard deviation obtained by the method described above, the reflection characteristic of the recording medium (and the image portion) is categorized into 6 categories (A through F). Table 1 shows 6 categories and the range of the standard deviation for each category.

TABLE 1

| CATEGORY | LOWER LIMIT [deg.] | UPPER LIMIT [deg.] |
|---|---|---|
| A | 0.0 | 0.0 |
| B | 0.5 | 1.0 |
| C | 1.0 | 2.0 |
| D | 2.0 | 4.0 |
| E | 4.0 | 6.0 |
| F | 6.0 | 10.0 |

According to the first illustrative embodiment, the angular distribution of the reflected light on both the non-image portion (sheet portion) and the image portion is detected using the method described above. It is to be noted that the non-image portion refers to an area where no image is formed. The image portion is an area where the image is formed.

The angular distribution of the reflected light on the non-image portion and the image portion is read by the surface reflection detector 7 when the detection sample image is output at a detection sample image output mode under the following condition.

[Fixation]

Linear velocity: 240 mm/sec.

Temperature of the fixing belt: 165 deg. C.

Temperature of the pressure roller 145 deg. C.

Subsequently, the reflection characteristics of the non-image portion and the detection sample image portion are categorized according to the conditions (standard deviation of the angular distribution of the reflected light) in Table 1. When the categories for the non-image portion and the image portion are determined, the actual image (output image) is output under the imaging condition determined by the combination of the respective categories of the non-image portion and the respective category of the image portion.

TABLE 2 shows the categories of the non-image portion and the image portion of the detection sample image, and corresponding imaging conditions in the image forming apparatus 100.

TABLE 2

| | | CATEGORY OF IMAGE PORTION | | | | | |
|---|---|---|---|---|---|---|---|
| | | A | B | C | D | E | F |
| CATEGORY OF NON-IMAGE PORTION | A | (1) | (1) | (5) | (5) | (5) | (5) |
| | B | (1) | (1) | (5) | (5) | (5) | (5) |
| | C | (1) | (1) | (1) | (2) | (3) | (4) |
| | D | (1) | (1) | (1) | (1) | (2) | (3) |
| | E | (1) | (1) | (1) | (1) | (1) | (2) |
| | F | (1) | (1) | (1) | (1) | (1) | (1) |

The category for the image portion is shown in the column. The category for the non-image portion is shown in the row. Based on experiments performed by the present inventor using some recording media sheets with the configuration of the first illustrative embodiment, shading portions in TABLE 2 indicate that perceived gloss of the image portion was greater than the non-image portion. However, when the detection sample image output mode was set to the fixing condition described above (Linear velocity: 240 mm/sec, Temperature of the fixing belt: 165 deg. C., Temperature of the pressure roller 145), the perceived gloss of the image portion was not greater than the non-image portion It is to be noted that even if a combination of the categories of the non-image portion and the image portion is found in the shading portion, it does not mean that the image forming apparatus 100 has a problem. If the actual output operation is performed under the condition (1) of TABLE 2, the sense of gloss uniformity can be achieved.

As described above, when the surface reflection detector 7 reads the angular distribution of the reflected light on the non-image portion and the image portion of the detection target (the detection sample image), the categories of the non-image portion and the image portion are determined. In accordance with the combination of the categories of non-image portion and the image portion, the appropriate imaging condition (fixing condition) is selected from TABLE 2 and an output image is output under the selected imaging condition.

With reference to TABLE 3, the detailed description of the imaging conditions indicated in TABLE 2 is provided.

TABLE 3

| IMAGING CONDITION | LINEAR VELOCITY [mm/sec] | TEMPERATURE OF FIXING BELT [deg.] | TEMPERATURE OF PRESSURE ROLLER [deg.] |
|---|---|---|---|
| (1) | 240 | 165 | 145 |
| (2) | 240 | 175 | 155 |
| (3) | 120 | 165 | 145 |
| (4) | 60 | 155 | 135 |
| (5) | 30 | 155 | 135 |

According to the first illustrative embodiment, the imaging condition is adjusted by adjusting the linear velocity at which the recording medium passes through the fixing device, the temperature of the fixing belt, and the temperature of the pressing roller. The fixing condition at the detection sample image output mode described above corresponds to the imaging condition (1) of TABLE 3.

Next, a detailed description is provided of adjustment of imaging conditions of the image forming apparatus 100 according to the first illustrative embodiment.

As described above, first, the detection sample image is output under the imaging condition (1) of TABLE 3. In the imaging condition (1), fixation is performed when the linear velocity is 240 mm/sec, the temperature of the fixing belt is 165 deg. C, and the temperature of the pressure roller is 145 deg. C.

The angular distribution of the reflected light on the non-image portion and the image portion of the detection sample image is read by the surface reflection detector 7. The image portion consisting of a red patch of 100% yellow and 100% magenta is used. In reality, an actual output image includes areas having various toner area ratios (0-400%). The reason for using the red patch for reading the image portion is that in order for a single patch to represent various toner area ratios, the red patch which is a secondary color having an area ratio of 200% is used. The image portion read by the surface reflection detector 7 is not limited to the red patch. Patches of different colors can be used. Alternatively, an average of a plurality of patches can be used.

As described above, FIG. 5 shows one example of the result of detection by the surface reflection detector 7 using the POD gloss coated sheet, manufactured by Oji Paper Corporation. Using the calculation method described above, the standard deviation σ is 3.7 degrees. For the purpose of comparison, glossiness measured by the 60-degree glossiness scale is 27%.

Figure 6:
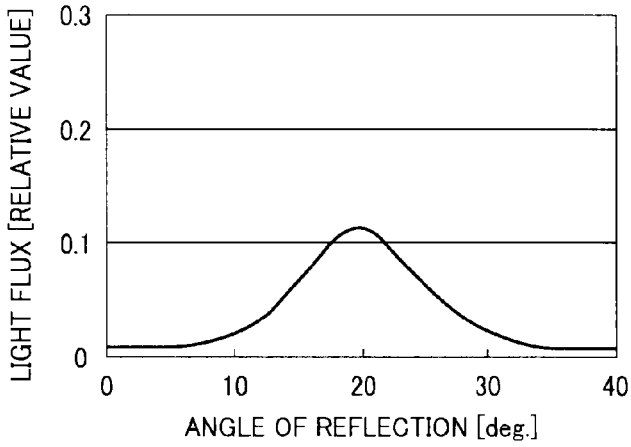
FIG. 6 is a graph showing an example of the angular distribution of reflection on an image portion of a detection sample image.

Referring now to FIG. 6, FIG. 6 shows a graph showing a result of detection of the image portion (red patch of the detection sample image) by the surface reflection detector 7. The result indicates that the standard deviation σ is 4.7 degrees. For the purpose of comparison, glossiness measured by the 60-degree glossiness scale is 28%.

Even if the glossiness of the non-image portion measured by the 60-degree glossiness scale is substantially similar to that of the image portion, the visual impression of the image is different. In other words, even if the visually perceived gloss of the image portion seems less than that of the non-image portion, lacking a sense of uniformity, the glossiness value measured by the 60-degree glossiness scale is substantially similar between the non-image portion and the image portion. When the glossiness measured by the 60-degree glossiness scale is substantially similar between the non-image portion and the image portion, this does not mean that the non-image portion and the image portion have the sense of gloss uniformity.

The non-image portion of the detection sample image belongs to the category D of TABLE 1. The image portion of the detection sample image belongs to the category E of TABLE 1. Based on the result, the imaging condition 2 (Linear velocity: 240, Temperature of the fixing belt: 175 deg. C., and Temperature of the pressure roller: 155 deg. C.) is selected.

Figure 7:
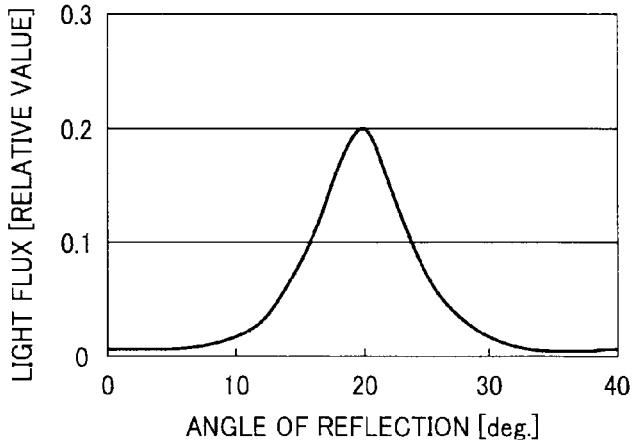
FIG. 7 is a graph showing an example of the angular distribution of reflection on an image portion of an output image.

FIG. 7 is a graph showing the result of reading of a real image portion read by the surface reflection detector 7. The standard deviation σ is 3.7 degrees (the 60-degree glossiness is 41%). Visually perceived gloss of the non-image portion and the image portion has a sense of gloss uniformity. As described above, the 60-degree glossiness of the non-image portion is 27%; whereas, the 60-degree glossiness of the image portion is 41%. There is a significant difference between the measured 60-degree glossiness of the non-image portion and the image portion. The 60-degree glossiness differs between the non-image portion and the image portion. However, the standard deviation of the non-image portion and that of the image portion substantially coincide with each other.

According to the present embodiment, since the angular distribution of the reflected light on both the non-image portion and the image portion is detected, the imaging conditions including, for example, the fixing conditions, can be adjusted in accordance with the detection result, thereby being able to output an image having a sense of gloss uniformity between the non-image portion and the image portion.

The light flux of the reflected light on the non-image portion differs from the image portion due to the difference in refraction. The relation between reflection and refraction is specified by Fresnel equations. As refraction increases, the surface reflection also increases.

The refraction of the recording medium is approximately 1.4. The refraction of toner is approximately 1.6. Assuming that the target surface has a specular surface, the reflection of the recording medium is 0.028, and the reflection of the toner is 0.053 using the Fresnel equations. The light flux reflected from the recording medium significantly differs from the light flux reflected from the toner.

The glossiness, generally measured by the method of 60-degree glossiness scale defined by JIS Z 8741, is obtained from the light flux reflected in the specified area substantially near the specular reflection of 60 degrees (divergence angle of receiving light within 4.4 degrees). Consequently, the measured value of the glossiness differs due to the difference in reflection described above.

By contrast, visually perceived gloss from the image depends largely on the angular distribution of the surface reflection or the distribution of reflected light. Because the surface of an image is not smooth, that is, the surface of the image has asperities, the incident light against the image is reflected from the asperities on the surface and expands. When the expansion of the reflected light is small (narrow), visually perceived gloss seems to be greater than when the expansion of the reflected light is large (wide).

The present inventor believes that visually perceived gloss is influenced by the angular distribution of the surface reflection (expansion of reflected light) for the following reasons.

The light that provides glossy feeling is very strong light compared with normal diffuse light. The normal diffuse light herein refers to light that is reflected isotropically on the recording medium and distinguishes the color of the image on the recording medium. For this reason, it is difficult for a person to distinguish intensity of such a strong light. In other words, such a strong light does not have sensitivity. One is sensitive to intensity of light when the light is relatively weak. That is, one can distinguish the intensity of such weak light. By contrast, when the light is strong, one is less sensitive to the intensity of such strong light.

In view of the above, in stead of matching the measured glossiness value of the non-image portion and the image portion, the degree of the angular distribution of the surface reflection of the non-image portion and the image portion is matched, thereby providing the sense of gloss uniformity between the non-image portion and the image portion.

The present inventor believes that the expansion of the angular distribution of the reflected light (i.e., the standard deviation) corresponds to visually perceived gloss for the following reasons.

The intensity of the surface reflection light (surface specular light) ranges from several times to several ten times the intensity of the diffuse reflection light. Thus, even if the intensity is substantially close to the tail of the surface reflection light, that is, the reflection angle of 15 to 25 degrees shown in the graph in FIG. 5, the intensity is strong enough for a person to perceive the gloss. The specular reflection light has an intensity far greater than the diffuse reflection light, and the size of the specular reflection light (whether large or small) cannot be distinguished by the perception of human beings. Rather, the angular distribution or the width of the distribution of the specular reflection light can be perceived by human beings.

Another reason is that the specular reflection light on the non-image portion and the image portion is recognized as reflection of lighting in a room or the like. A feeling of gloss that a person perceives is determined by the shape of such reflection of lighting. The width or the degree of reflection of lighting in the room or the like, that is, the degree of blur of the reflection, needs to be the same in the non-image portion and the image portion in order to achieve the gloss uniformity therebetween.

In a case in which the reflection of the lighting in the room on the non-image portion is blur, but the reflection of the lighting is sharp on the image portion, or visa versa, the sense of gloss uniformity is not achieved.

The degree of sharpness of the reflection of lighting in the room or the like is manifested in accordance with the expansion of the surface reflection light described above. That is, in order to make the sharpness of the reflection of lighting be the same in the non-image portion and in the image portion, it is more effective to make the expansion of the angular distribution of the reflection light be the same in the non-image portion and in the image portion, instead of making the measured glossiness be the same between the non-image portion and the image portion.

According to the present embodiment, the angular distribution of the reflected light (expansion of the surface reflection) on both the non-image portion and the image portion is directly measured, and the imaging conditions such as fixing conditions are adjusted to match the angular distribution of the reflection light on the non-image portion and the image portion. With this configuration, a high-quality image providing the uniform glossy feeling on the non-image portion and on the image portion is formed.

Embodiment 2

Figure 8:
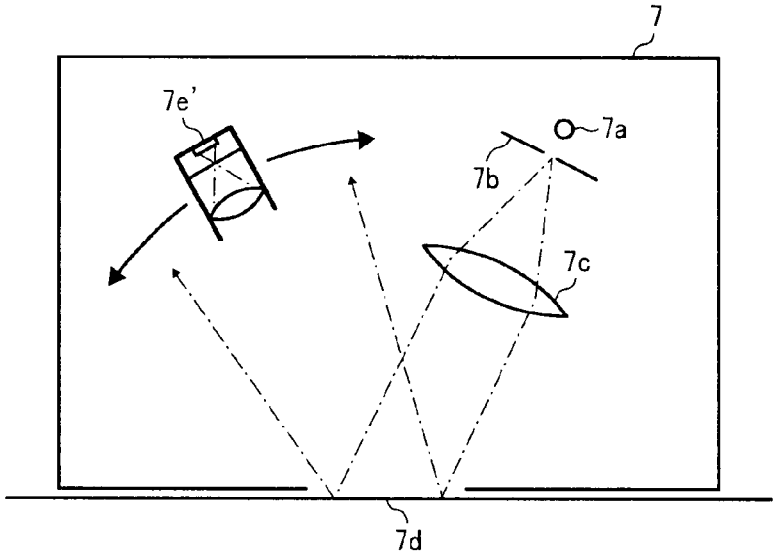
FIG. 8 is an explanatory schematic diagram illustrating the surface reflection detector according to a second illustrative embodiment of the present invention.

Referring now to FIG. 8, there is provided a schematic diagram illustrating the surface reflection detector 7 according to a second illustrative embodiment. According to the present embodiment, the surface reflection detector 7 includes the light projecting device 7*a*, the aperture 7*b*, the collimating lens 7*c*, and a light receiving device 7*e*'. The light receiving device 7*e*' is configured to move in an arc shape indicated by an arrow to detect the angular distribution of the reflected light.

In the light receiving potion 7*e*', the light collected by a light collecting lens is shaped by the aperture into a desirable shape. After passing through the aperture, the light is converted into electric signals by the CCD element so that the intensity converted to the electric signals is output.

With this configuration, similar to the first illustrative embodiment, the angular distribution of the reflected light can be detected, thereby achieving the same effect of the first illustrative embodiment. In particular, the angular distribution of the reflected light on the non-image portion and the image portion is detected. The imaging conditions including the fixing conditions are adjusted in accordance with the detection result. Accordingly, an image providing the uniform glossy feeling on the non-image portion and on the image portion is formed.

In the second illustrative embodiment, the angular distribution of the reflected light (expansion of the surface reflection) is represented by a one-dimensional numeric value. With this configuration, a change in the surface reflection characteristics of the image due to a change in the imaging conditions can be easily adjusted with a simple controlling method.

Embodiment 3

According to a third illustrative embodiment, the calculation method of obtaining a value that characterizes a the expansion of the reflected light derived from the angular distribution of the reflected light is different from the first illustrative embodiment.

According to the first illustrative embodiment, the standard deviation of the angular distribution of the reflected light is obtained by approximating the angular distribution of the reflected light with the normal distribution. The standard deviation characterizes the expansion of the reflected light.

Figure 9:
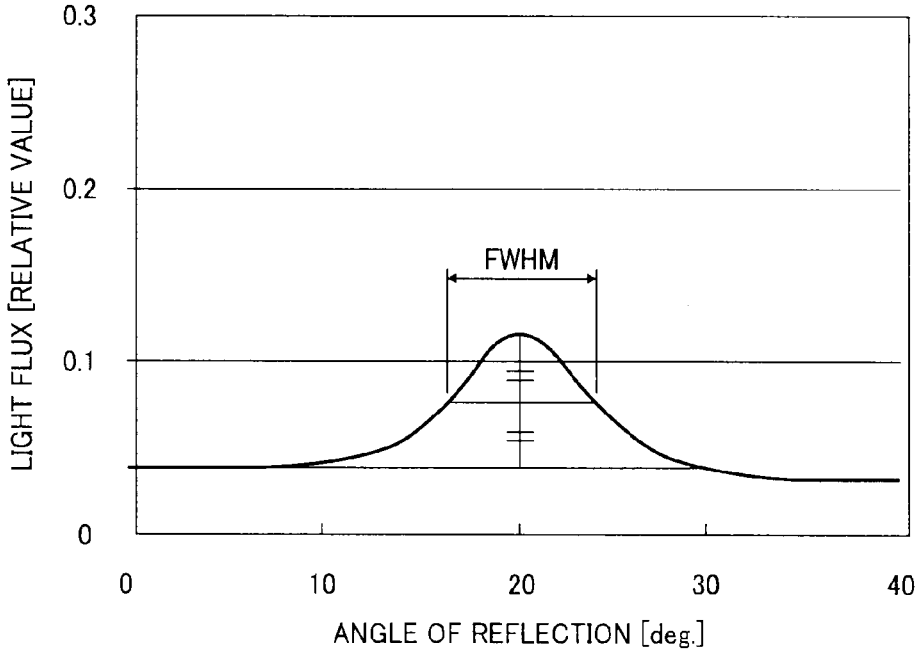
FIG. 9 is a graph for explaining a full width at half maximum (FWHM) in the angular distribution of the reflection.

By contrast, according to the third illustrative embodiment, a full width at half maximum (hereinafter referred to as FWHM) is used to characterize the expansion of the reflected light. FIG. 9 shows the FWHM which is the width between points that are half the peak value. According to the third illustrative embodiment, the FWHM represents the angular width.

According to the third illustrative embodiment, the FWHM is derived from the angular distribution of the reflected light, and similar to the first illustrative embodiment, the characteristic of the reflected light of the detection target is categorized into 6 categories as shown in TABLE 1.

Even if the angular distribution of the reflected light is the same, the standard deviation of the angular distribution of the reflected light is obtained as a value different from the value of the FWHM. Thus, the characteristic of the reflected light needs to be categorized in accordance with values different from TABLE 1. TABLE 4 shows the relation of the categories and the FWHM (angle).

TABLE 4

| CATEGORY | LOWER LIMIT [deg.] | UPPER LIMIT [deg.] |
|---|---|---|
| A | 0.0 | 1.0 |
| B | 1.0 | 3.0 |
| C | 3.0 | 6.0 |
| D | 6.0 | 9.0 |
| E | 9.0 | 14.0 |
| F | 14.0 | 24.0 |

Using TABLE 4, similar to the first illustrative embodiment, the characteristics of the reflection on the non-image portion and the image portion are categorized.

The advantage of using the FWHM instead of the standard deviation is that the FWHM can be derived from the angular distribution of the reflected light more easily from the standard deviation, thereby enabling quick calculation.

The operation after categorizing the reflection characteristics is the same as the foregoing embodiments. Thus, the description is omitted herein.

According to the third illustrative embodiment, similar to the first illustrative embodiment, the angular distribution of the reflected light can be detected, thereby achieving the same effect as the first illustrative embodiment. In particular, the angular distribution of the reflected light on both the non-image portion and the image portion is detected. In accordance with the detection result, the imaging conditions including the fixing conditions are adjusted, thereby forming an image providing the uniform glossy feeling on the non-image portion and on the image portion is formed. Furthermore, the characteristic value can be derived easily. Thus, calculation load can be reduced.

According to the third illustrative embodiment, the FWHM of the angular distribution which is a one-dimensional numeric value represents the angular distribution of the reflected light (expansion of the reflected light). Therefore, the value can be derived easily by simply looking up the angular distribution of the reflected light and finding the angle that is half the peak value, thereby allowing characterization of the surface reflection characteristics with a simple configuration.

Embodiment 4

Figure 10:
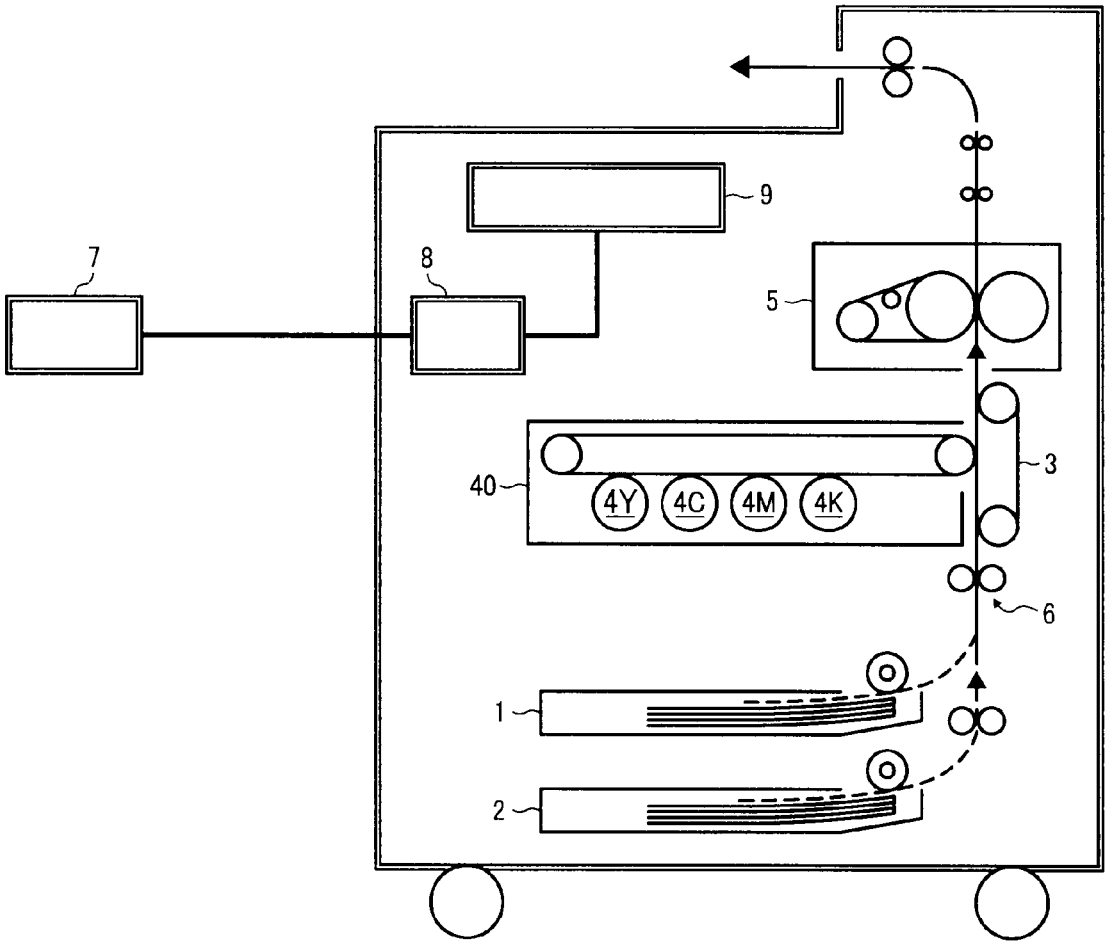
FIG. 10 is an explanatory schematic diagram illustrating the image forming apparatus according to a fourth illustrative embodiment of the present invention.

Referring now to FIG. 10, there is provided a schematic diagram illustrating the image forming apparatus 100 according to a fourth illustrative embodiment of the present invention. The image forming apparatus 100 of the present embodiment includes a sheet evaluation device 8 and a display device 9. The same reference numerals (1 through 7) are given to devices having the same configuration as the first illustrative embodiment, and the descriptions thereof are omitted.

In FIG. 10, based on the characteristics of the angular distribution of the reflected light detected by the surface reflection detector 7, the sheet evaluation device 8 determines whether the recording medium is appropriate for forming an output image thereon. When the sheet evaluation device 8 determines that the recording sheet is not appropriate, the display device 9 notifies an user of the decision by displaying the decision.

According to the present embodiment, similar to the first illustrative embodiment, the angular distribution of the reflected light on the non-image portion (the recording medium) is detected, and the standard deviation of the angular distribution is obtained. If the angular distribution is $\sigma<=1.0$, the sheet evaluation device 8 determines that it is difficult to form an image providing the uniform glossy feeling on the non-image portion and on the image portion. Subsequently, the display device 9 notifies the user of the decision that the present recording medium is not appropriate.

An example of the image forming apparatus 100 according to the present invention is an electrophotographic image forming apparatus. In such an image forming apparatus, when generally-used toner and a known fixing device are used, in general, it is difficult to obtain the standard deviation of $\sigma<=1.0$ for the angular distribution of the reflected light on the image portion. Consequently, it is difficult to obtain the image portion having the similar, if not the same standard deviation as that of the recording medium when the standard deviation of the non-image portion is $\sigma<=1.0$. In other words, when the standard deviation of the non-image portion of the recording medium is $\sigma<=1.0$, it is difficult to output an image providing the uniform glossy feeling on the non-image portion and on the image portion to the extent of the characteristics of the toner.

In such a case, if the user is notified of inapplicability of the recording medium before forming the image on the recording medium, unnecessary consumption of the recording medium and the toner is prevented, thereby enhancing convenience for the user.

The standard deviation of $\sigma<=1.0$ for the angular distribution of the reflected light on the image portion tends to be more difficult to achieve in an image forming apparatus employing oil-less fixing method which is becoming the mainstream in the electrophotographic image forming apparatus in recent years.

This is because the toner that can be used in the oil-less fixation needs to have a relatively large elastic property in order to prevent a problem so-called "hot offset" in which part of a fused toner image adheres to the surface of a heating member, and is re-transferred onto the sheet or the subsequent sheet of the recording medium. This is conflicting because when forming a surface of the image as smooth as possible during fixation, resin material having a small elastic property is needed.

In view of the above, the image forming apparatus according to the fourth illustrative embodiment is more advantageous in that the angular distribution of the reflected light on both the non-image portion and the image portion is detected, and if the recording medium itself is identified as inappropriate, that is, the standard deviation of the angular distribution of the reflected light on the non-image portion is $\sigma<=1.0$, the user is notified of inappropriateness of the recording medium before outputting the image. Accordingly, a waste of toner as well as the recording medium such as coated paper, which is generally more expensive than ordinary paper, can be prevented.

With this configuration, the angular distribution of the reflected light on the non-image portion (the recording medium) is detected before the image (the real image) is formed on the recording medium. When the angular distribution of the reflected light on the image portion of the detection sample image is out of an adjustable range, the user is notified of inapplicability of the recording medium. Accordingly, a waste of paper and toner can be prevented.

In accordance with the angular distribution of the reflected light on both the non-image portion and the image portion, the imaging conditions including the fixing conditions can be adjusted, thereby forming an image providing the uniform glossy feeling on the non-image portion and on the image portion.

Embodiment 5

Figure 11:
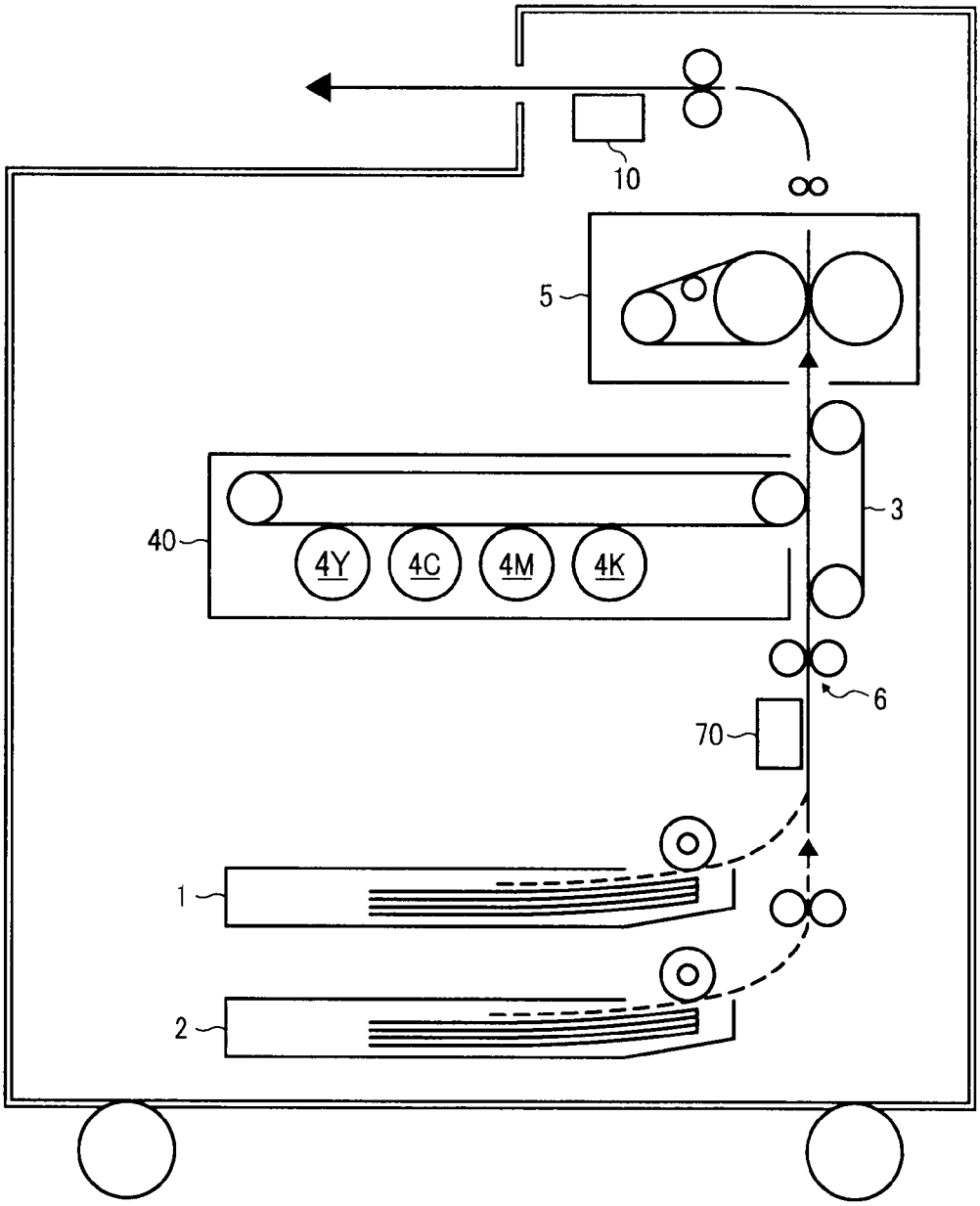
FIG. 11 is an explanatory schematic diagram illustrating the image forming apparatus according to a fifth illustrative embodiment of the present invention.

Referring now to FIG. 11, there is provided a schematic diagram illustrating the image forming apparatus 100 according to a fifth illustrative embodiment of the present invention. The image forming apparatus 100 of the present embodiment includes a first surface reflection detector 70 and a second surface reflection detector 10. The first surface reflection detector 70 detects the angular distribution of reflected light on the recording medium such as paper. The second surface reflection detector 10 detects the angular distribution of reflected light on the image portion formed on the recording medium at the detection sample image output mode. Based on the angular distribution of the reflected light on both the recording medium and the image portion, the imaging conditions are adjusted, and an image is output.

In FIG. 11, the same reference numerals (1 through 6) are given to devices having the same configuration as the first illustrative embodiment, and the descriptions thereof are omitted.

In FIG. 11, the first surface reflection detector 70 is disposed before the image forming station 40 and detects the characteristics of the angular distribution of the reflected light on the recording medium. The second surface reflection detector 10 detects the angular distribution of the reflected light on the image portion formed on the recording medium at the detection sample image output mode.

The processing after detection of the angular distribution of the recording medium and the image portion is the same as the first illustrative embodiment. That is, the imaging conditions including the fixing conditions are adjusted in the same manner as the first illustrative embodiment.

According to the fifth illustrative embodiment, since two surface reflection detectors detecting the angular distribution of reflected light on the non-image portion and the image portion are provided separately in the image forming apparatus 100, the user does not need to operate the surface reflection detector to read the non-image portion and the image portion as compared with the first illustrative embodiment. According to the fifth illustrative embodiment, the user simply needs to place the recording medium on the sheet feed tray of the image forming apparatus and instructs start of the detection sample image output mode. Subsequently, the imaging conditions for forming the image having desirable gloss are set automatically. With this configuration, the number of operations that the user performs can be reduced.

Since the first surface reflection detector 70 is disposed before the image forming unit, the angular distribution of the reflected light on the recording medium can be detected before the image is formed. Together with the configuration of the fourth illustrative embodiment, if the angular distribution thereof is less than the predetermined value, that is, if the standard deviation is $\sigma<=1.0$, for example, the present recording medium is identified as inappropriate and the user is notified of inappropriateness of the present recording medium. Accordingly, the image is prevented from being formed on the recording medium at the detection sample image output mode, thereby saving paper and toner.

Furthermore, with this configuration, the angular distribution of the reflected light on the recording medium can be detected before the detection sample image is formed at the detection sample image output mode. By contrast, according to the fourth illustrative embodiment, a sheet of the recording medium may be wasted to output the detection sample image.

According to the fifth illustrative embodiment, the angular distribution of the reflected light on both the recording medium (non-image portion) and the image portion can be detected, thereby achieving the same effect as that of the first illustrative embodiment. In accordance with the result of detection, the imaging conditions including the fixing conditions can be adjusted to form an image having desirable gloss. That is, the image providing the uniform glossy feeling on the non-image portion and on the image portion is formed.

Embodiment 6

Figure 12:
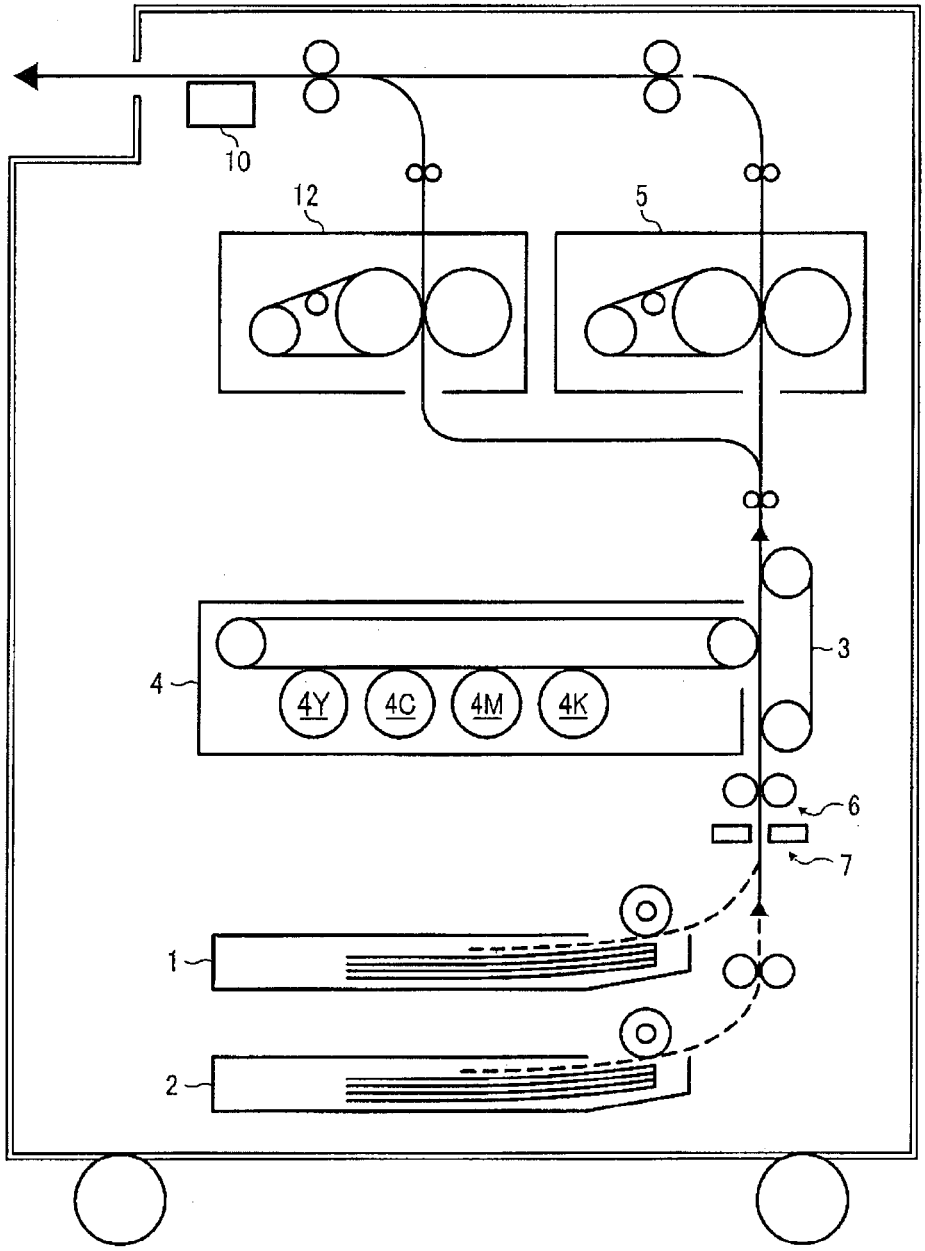
FIG. 12 is an explanatory schematic diagram illustrating the image forming apparatus according to a sixth illustrative embodiment of the present invention.

Referring now to FIG. 12, there is provided a schematic diagram illustrating a sixth illustrative embodiment of the present invention. According to the sixth illustrative embodiment, the image forming apparatus 100 includes two fixing devices. The fixing device 5 serves as a first fixing device. A fixing device 12 serves as a second fixing device.

In FIG. 12, the recording medium on which the image is transferred is carried on the transportation belt 3. Based on the angular distribution (standard deviation) of the reflected light on the recording medium and the image portion of the detection sample image, the fixing conditions to output the output image are determined.

Similar to the first illustrative embodiment, the fixing conditions are determined in accordance with TABLE 2 and TABLE 3. In accordance with the result, the recording medium is transported to either the first fixing device 5 or the second fixing device 12 having different fixing conditions.

According to the sixth illustrative embodiment, the fixing conditions are adjusted by switching the fixing devices through which the recording medium passes. The same effect as the first illustrative embodiment can be achieved by selecting the fixing device to use based on the angular distribution of the reflected light. With this condition, a standby time required for changing the fixing temperature is reduced when the fixing devices 5 and 12 have different fixing temperatures.

In the sixth illustrative embodiment, similar to the foregoing embodiments, the angular distribution of the reflected light on both the non-image portion and the image portion is detected. In accordance with the result of detection, the fixing conditions can be adjusted, thereby obtaining an image with desirable gloss.

Furthermore, according to the sixth illustrative embodiment, fixing parameters include, but are not limited to the fixing temperature and the speed as in the first illustrative embodiment. In addition, the fixing parameters may include a cold-release system in which the fused toner is cooled immediately after the toner is fused and released from the fixing belt, thereby making the surface of the toner smooth and glossy. With this configuration, the image forming apparatus can accommodate a wide variety of recording media sheets.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image forming unit; and a surface reflection detector to detect reflection characteristics of a surface of a recording medium, the image forming unit including an image forming station to form a detection sample image and a toner image on the recording medium;

a controller to set a detection sample image output mode to output the detection sample image; and a fixing device to fix the detection sample image and the toner image on the recording medium, the surface reflection detector connected to the controller and including a projector to project parallel light against a target; and an angular distribution detector to detect an angular distribution of light reflected by the target, the angular distribution detector detecting the angular distribution of reflected light on the recording medium and on the detection sample image formed on the recording medium, the image forming unit forming an output image on the recording medium by adjusting imaging conditions based on the angular distribution of reflected light on the recording medium and the detection sample image detected by the angular distribution detector.

2. The image forming apparatus according to claim 1, wherein the surface reflection detector obtains and outputs a standard deviation of the angular distribution of the reflected light detected by the angular distribution detector by approximating the angular distribution of reflected light with a normal distribution.

3. The image forming apparatus according to claim 1, wherein the surface reflection detector outputs a full width at half maximum (FWHM) in the angular distribution of the reflected light detected by the angular distribution detector.

4. The image forming apparatus according to claim 1, further comprising:

a sheet evaluation device to determine whether or not the recording medium is appropriate for forming the output image thereon based on the angular distribution information of the reflected light on the recording medium provided by the surface reflection detector; and a display device to inform a user when the recording medium is inappropriate.

5. The image forming apparatus according to claim 1, wherein the fixing device fixes the toner image formed of dry toner in powder form on the recording medium by heating and pressing the toner image onto the recording medium.

6. The image forming apparatus according to claim 5, wherein fixing conditions of the fixing device are adjustable and include at least one of a temperature and a linear velocity of the recording medium.

7. The image forming apparatus according to claim 1, further comprising:

a plurality of fixing devices having mutually exclusive fixing conditions to fix the toner image formed of dry toner by heating and pressing the toner image onto the recording medium, wherein the imaging conditions are adjusted by selecting one fixing device from among the plurality of fixing devices through which to pass the recording medium.

8. The image forming apparatus according to claim 1, wherein the image forming station uses four different colors of toner, cyan, magenta, yellow, and black, to form the toner image.

9. An image forming apparatus comprising:

an image forming unit;

a first surface reflection detector; and a second surface reflection detector, the image forming unit including an image forming station to form a detection sample image and a toner image on a recording medium;

a controller to set a detection sample image output mode to output the detection sample image; and a fixing device to fix the detection sample image and the toner image on the recording medium;

the first surface reflection detector disposed proximal of the image forming station to detect reflection characteristics of the recording medium and including a first projector to project parallel light against the recording medium; and a first angular distribution detector to detect an angular distribution of light reflected from the recording medium, the second surface reflection detector disposed distal of the fixing device to detect reflection characteristics of the detection sample image on the recording medium and including a second projector to project parallel light against the detection sample image; and a second angular distribution detector to detect an angular distribution of light reflected from the detection sample image;

wherein the image forming unit forms an output image on the recording medium by adjusting imaging conditions based on the angular distribution of reflected light on the recording medium and on the detection sample image detected by the first angular distribution detector and the second angular distribution detector.

10. The image forming apparatus, according to claim 9, wherein each of the first surface reflection detector and the second surface reflection detector obtains and outputs a standard deviation of the angular distribution of the reflected light detected by the first angular distribution detector and the second angular distribution detector, respectively, by approximating the angular distribution of reflected light provided by the first angular distribution detector and the second angular distribution detector with a normal distribution.

11. The image forming apparatus, according to claim 9, wherein each of the first surface reflection detector and the second surface reflection detector outputs a full width at half maximum (FWHM) in the angular distribution of the reflected light acquired by the first angular distribution detector and the second angular distribution detector.

12. The image forming apparatus according to claim 9, further comprising:

a sheet evaluation device to determine whether or not the recording medium is appropriate for forming the image thereon based on the angular distribution information of the reflected light on the recording medium provided by the first surface reflection detector; and a display device to inform a user when the recording medium is inappropriate.

13. The image forming apparatus according to claim 9, wherein the fixing device fixes the toner image formed of dry toner in powder form on the recording medium by heating and pressing the toner image onto the recording medium.

14. The image forming apparatus according to claim 13, wherein fixing conditions of the fixing device are adjustable and include at least one of a temperature and a linear velocity of the recording medium.

15. The image forming apparatus according to claim 9, wherein the image forming station uses four different colors of toner, cyan, magenta, yellow, and black, to form the toner image.

* * * * *